United States Patent [19]

Hudspeth

[11] Patent Number: 4,777,459

[45] Date of Patent: Oct. 11, 1988

[54] MICROWAVE MULTIPLEXER WITH MULTIMODE FILTER

[75] Inventor: Thomas Hudspeth, Malibu, Calif.

[73] Assignee: Hughes Aircraft Company, Los Angeles, Calif.

[21] Appl. No.: 59,707

[22] Filed: Jun. 8, 1987

[51] Int. Cl.[4] ..... H01P 1/208; H01P 1/213

[52] U.S. Cl. ..... 333/135; 333/21 R; 333/209; 333/212; 333/230

[58] Field of Search ..... 333/208, 209, 210, 211, 333/212, 135–137, 132–134, 21 R, 1, 21 A, 230, 248

[56] References Cited

U.S. PATENT DOCUMENTS 4,614,920 9/1986 Tong ..... 333/212 X

OTHER PUBLICATIONS

Southworth, "Principles and Applications of Waveguide Transmission", fifth printing, D. Van Nostrand Co., Inc., Princeton, New Jersey, Sep. 1961, pp. 120, 325–331 and title page.

Williams et al, Dual-Mode Canonical Waveguide Filters", IEEE Trans. on Microwave Theory and Techniques, vol. MTT-25, No. 12, Dec. 1977; pp. 1021–1026.

*Primary Examiner*—Marvin L. Nussbaum

*Attorney, Agent, or Firm*—Steven M. Mitchell; Mark J. Meltzer; A. W. Karambeles

[57] ABSTRACT

A microwave multiplexer has a set of independently tuneable signal channels coupled to a common waveguide. Each of the channels has input and output 3 dB couplers which are joined by cylindrical radiators carrying circularly polarized waves. Both TE and TM waves are propagated within a plurality of resonant cavities within each of the filters. Coupling between the cavities is provided by an array of slots and an array of probes wherein the slots couple TE waves and the probes couple TM waves. Adjustment of the slots and the probes provides for independent coupling coefficients for the two propagation modes. A set of coaxial line probe structures connect between the input and output couplers to end cavities of a filter for the launching of TM waves, there being discs in the end cavities adjacent the probes for converting energy of a TM wave to a TE wave, thereby providing both the TM and the TE wave propagation. There results a greater versatility in the coupling allowing for greater compaction of signal channel with reduced weight and bulk to the multiplexer.

20 Claims, 2 Drawing Sheets

MICROWAVE MULTIPLEXER WITH MULTIMODE FILTER

BACKGROUND OF THE INVENTION

This invention relates to multiplexers of microwave electromagnetic signals which differ in frequency and, more particularly, to a multiplexer having a plurality of channels tuned to specific frequencies, each channel including a filter for coupling both transverse-electric (TE) and transverse-magnetic (TM) waves to shape a bandpass characteristic with steeper skirts to allow for a closer spaceing of contiguous signal bands.

Microwave multiplexers are employed in a variety of communication systems ranging from radar to telemetry. For example, in the case of a satellite carrying two highly directive antennas for receiving two signals at different frequency bands, the two signals received from the respective antennas are advantageously combined via a microwave multiplexer. The multiplexer outputs the two signals in a common channel of broader bandwidth. Thereby, a single microwave channel receives both of the signals. Such a multiplexer may be reciprocal in its operation such that a plural-band signal traversing the multiplexer in the reverse direction can be split into two separate signals each having its own spectral transmission band. If desired, such multiplexers may be constructed to accommodate more than two spectral bands. It is advantageous if the various bands can be placed together as closely as possible so as to reduce the required bandwidth of the common output channel of the multiplexer.

A problem arises in that, in the past, the bandpass characteristic of the resonant structure in each of the channels of the multiplexer has had wider skirts than is desireable, the excess width of the skirts necessitating additional spacing between contiguous ones of the signal bands to ensure adequate channel separation. This reduces the number of separate signal channels that can be combined into a single output channel of prescribed bandwidth.

SUMMARY OF THE INVENTION

The aforementioned problem is overcome and other advantages are provided by a multiplexer having a set of individually tuned input channels, the tuning of each channel being provided by a resonant structure composed of a plurality of resonant chambers or cavities. In accordance with the invention, each of the chambers is provided with coupling structures which excite both TE and TM modes of electromagnetic wave propagation. The resultant resonant structure for each channel has a bandpass characteristic which is characterized by a reduction in the width of the skirts, that is, the skirts are steeper allowing for a closer placement of the contiguous signal channels while retaining adequate isolation between the signals of contiguous channels.

In a preferred embodiment of the invention, the launching of the TE and TM waves is accomplished by use of a 3 dB (decibels) coupler constructed with adjacent waveguides sharing a common wall, and wherein coupling probes are located in each of the waveguides. Thereby, a 90 degree phase shift is introduced between the two probes. The two probes penetrate a first chamber of the filter at an end wall thereof, there being a metallic disc located on the end wall alongside the two probes. In addition, two tuning posts are positioned on the opposite side of the disc and are arranged parallel to the two probes, the two turning posts and the two probes being uniformly positioned about the metallic disc. The probes excite TM waves in the chamber, and the disc interacts with the TM waves to excite a TE wave within the chamber.

Coupling of electromagnetic energy between successive ones of the chambers within a channel is accomplished by a composite coupling structure, a portion of which provides for the coupling of TM waves, and a portion of which provides for the coupling of TE waves. The composite coupling structure is placed in a common end wall between adjacent chambers. A set of four circular-segment slots provides for the coupling of TE waves, while a set of probes passing through the common end wall and extending into both of the chambers couples TM waves. The four probes are centered in respective ones of the four slots.

The 3 dB coupler structure is applied to the chambers at both ends of the resonant structure, one 3 dB coupler being at an input port and the other 3 dB coupler being appended to a side wall of a common output waveguide which connects the individual resonant structures of the respective channels. A feature of this structure is that a group of microwave signals of different frequencies propagating through the common output waveguide, and incident upon individual ones of the output couplers, react with the couplers in a manner dependent on the resonant frequencies of the respective channels. Signals having frequencies different from the resonant frequency of a specific channel are essentially unaffected by the presence of the channel and, accordingly, can propagate through the output waveguide without interference of the other channels. On the other hand, a microwave signal incident upon the coupler of a channel resonant at the frequency of the microwave signal is coupled into the resonant structure to propagate through that channel structure. Reciprocal propagation is attained in the multiplexer structure such that signals can propagate from input ports to a common output port for combination of a set of the signals, and can propagate from the common output port to the set of input ports for separation of the signals of a group of microwave signals.

The resonant structure in each of the channels may be regarded as a filter for passing the signal of a specific channel while rejecting signals of other channels. The individual chambers or cavities in each of the resonant structures may be regarded as filter sections, an increase in the number of filter sections providing for a sharper tuning of the passbands of the respective filters. Coefficients of coupling of microwave energy between the chambers of a resonant structure can be selected, in accordance with filter theory, to shape the bandpass characteristic. In view of the fact that the coupling structure between successive chambers is a composite structure for coupling both TE and TM waves, the slots thereof for coupling TE waves are positioned at a radial distance from the center of the common wall at which distance no transverse current from a TM wave is present. The probes located in the centers of the slots extend a sufficient distance away from the common wall so as to interact with the TM waves. Thereby, the composite coupling structure is able to process both TE and TM waves. In addition, by selecting a length to the probes and a length to the slots, coefficients of coupling are readily established for optimizing the shape of the bandpass characteristic in a signal channel. The structure of the filter of a single channel may be used for processing signals in microwave equipment other than multiplexers.

BRIEF DESCRIPTION OF THE DRAWING

The foregoing aspects and other features of the invention are explained in the following description, taken in connection with the accompanying drawing wherein:

FIG. 5 shows the bandpass characteristic of the filter of FIG. 4 operative with both transverse-electric and transverse-magnetic modes in accordance with the invention.

DETAILED DESCRIPTION

Figure 1:
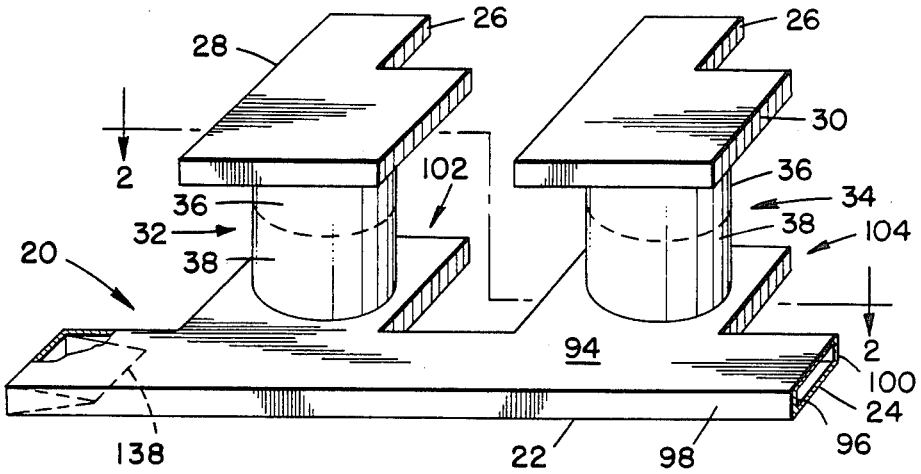
FIG. 1 is an perspective view of an embodiment of the multiplexer of the invention having two input ports and one output port.
Figure 2:
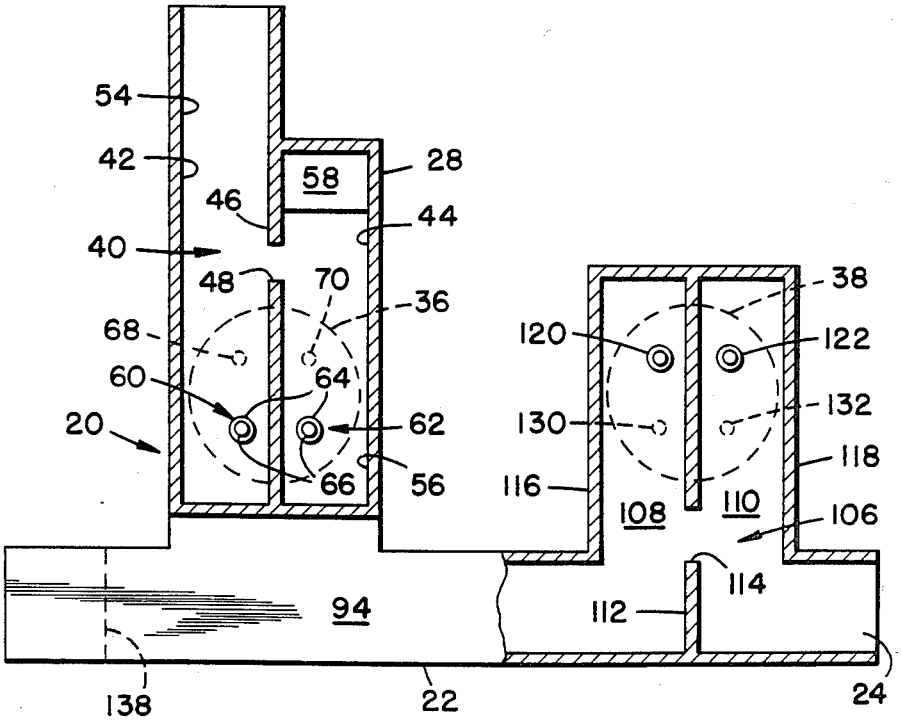
FIG. 2 is a plan view of the multiplexer of FIG. 1, the view of FIG. 2 being partially sectioned along the line 2—2 in FIG. 1 to show the interior construction of an input waveguide assembly of a first signal channel and the interior construction of an output waveguide assembly of a second input signal channel.
Figure 3:
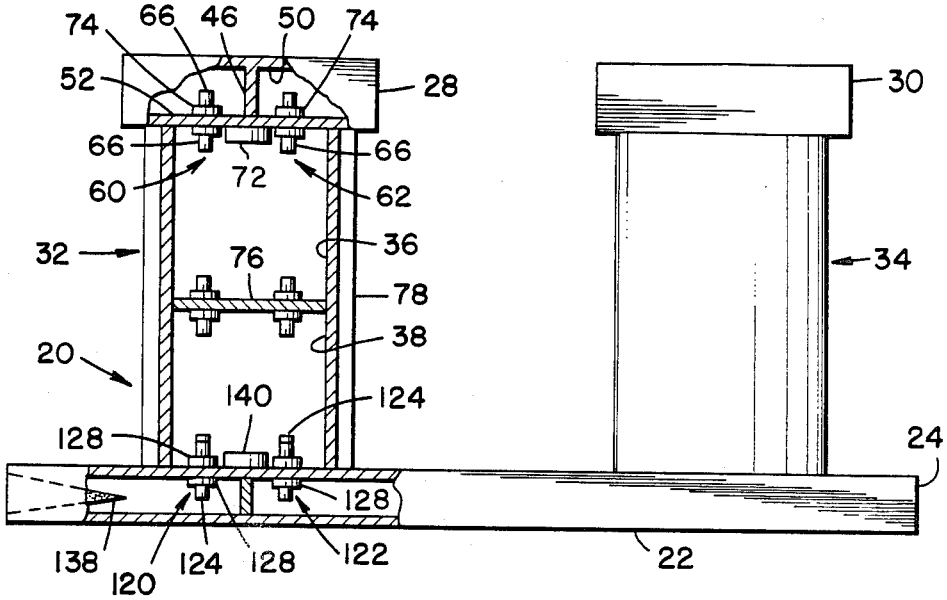
FIG. 3 is an elevation view of the multiplexer of FIG. 1, the view in FIG. 3 being partially sectioned to show transverse-electric and transverse-magnetic coupling structures within a filter of a signal channel.

With reference to the figures, there is shown a microwave multiplexer 20 comprising a waveguide 22 having an output port 24. A plurality of input ports 26, two of which are shown in the figures, are formed within input waveguide assemblies 28 and 30 coupled via cylindrical filters 32 and 34, respectively to the waveguide 22. Input signals, in the form of electromagnetic waves, are inputted at respective ones of the input ports 26 to be combined by the multiplexer 20, whereby the sum of the input signals, (two input signals in FIG. 1) is outputted at the output port 24.

Each of the filters 32 and 34 comprises a plurality of resonating cavities or chambers 36 and 38. While only two of the chambers 36, 38 are shown in each of the filters 32 and 34, it is to be understood that three or more such resonating chambers may be employed if desired. As is well known, the resonant frequency of each of the resonating chambers 36 and 38 is dependent on the dimensions of the chambers 36 and 38. Each of the chambers 36 and 38 is formed as a right cylindrical section having a prescribed diameter and height, which diameter and height are selected to provide for a desired resonant frequency of electromagnetic waves induced in the chambers 36 and 38 in response to input signals applied to the input ports 26. Thereby, the filters 32 and 34 are tuned to their respective channel frequencies.

A useful characteristic of the filters 32 and 34 is manifested at the coupling of each of the filters 32 and 34 to the waveguide 22. A microwave signal propagating in the waveguide 22 will be coupled into a filter 32, 34 if the passband of the filter contains the frequency of the microwave signal. However, if the resonating frequency of the filter 32, 34 differs from the frequency of the microwave signal, then the microwave signal is rejected by the filter 32, 34 and continues to propagate through the waveguide 22 without significant interaction with the filter 32, 34. Similar comments apply to any other filters (not shown) which may be coupled to the waveguide 22. This characteristic is most useful in the combining of plural input signals because an input signal or a sum of input signals entered into the waveguide 22 can continue to propagate through the waveguide 22 without interference by the other filters. It is to be understood that, in the construction of the multiplexer 20, all of the filters are constructed to resonate at different frequencies, thereby to enable the multiplexing of signals of different frequencies to provide the sum signal at the output port 24.

It is also noted that the operation of the multiplexer 20 is reciprocal so that a signal comprised of the sum of a plurality of signals at different frequencies can be inputted at the output port 24 whereupon each of the microwave signals will exit respective ones of the ports 26 whereby each of the component microwave signals has been separated in accordance with the frequencies of the respective microwave signals.

Upon using the multiplexer 20 to multiplex a set of signals occupying different portions of the microwave spectrum, it is noted that a set of the input signals constitutes an input band of signals, in which each of the microwave signals occupies a portion of the band. While, ideally, each portion of the band allocated to a specific microwave signal is contiguous to the portion allocated to the next microwave signal, in practice, the band portions are separated by stop bands to allow space for the skirts of the bandpass characteristics of the respective filters as shown in FIG. 5. The amount of space designated for the skirts limits the efficiency of band utilization. Sharper skirts permit each of the useful portions of the band to be positioned more closely together so as to avoid a wasting of frequency space in the band. As is well known, the number of resonators in a chamber, and the number of chambers employed in each of the filters effects the bandpass characteristic portrayed in FIG. 5. While the skirts can be made more steep by increasing the number of chambers from the two chambers 36 and 38 in this embodiment of the invention, such additional chambers increases the complexity of the structure, and make the structure more difficult to tune than the relatively simple structure of the filters 32 and 34.

In accordance with the invention, the skirts of the bandpass characteristic of each of the filters are made more steep so as to permit a more close spacing of the adjacent signal portions of the spectrum by coupling a plurality of electromagnetic transmission modes through the filters 32 and 34. A single mode of electromagnetic wave is associated with broader skirts while the use of a coupling structure in the filters which provides for the propagation of plural modes, both transverse electric (TE) and transverse magnetic (TM), of electromagnetic waves provides the desired narrowing of the skirts of an individual filter pass band.

The invention provides for the coupling of both TE and TM within each of the filters 32 and 34. Both of these modes of waves carry power in the direction of the central axis in each of the filters 32 and 34. Since both of the filters 32 and 34 and both of the input waveguide assemblies 28 and 30 have the same form, except for their respective physical sizes which differ, only the filter 32 will be described in detail, it being understood that the same description applies to the other filter 34.

The TE and TM waves may be described in cylindrical coordinates of r (radius of a resonant chamber), $\theta$ (angle measured along the cylindrical surface about a central cylindrical axis), and z (the central cylindrical axis). In the foregoing cylindrical coordinates, the TE wave exists in a pair of $TE_{112}$ modes, and the TM wave exists in a pair of $TM_{110}$ modes. As will be understood from the ensuing description of the filters 32 and 34, there are two waveforms of the $TE_{112}$ modes which are orthogonally polarized relative to each other and, also, two waveforms of the $TM_{110}$ modes which are orthogonally polarized relative to each other. Resonance occurs in both waveforms of the TE and the TM modes at the same frequency because of the chamber configuration. There is no variation along the Z axis in the TM modes while, in each of the TE modes, there is one full guide wavelength of electromagnetic wave along the Z axis. The electromagnetic energy is coupled into and out of the filter 32, 34 by the TM modes, a part of the energy being converted into the TE modes within the filter 32, 34. The launching of the TM modes of electromagnetic radiation into the filters 32 and 34 from the input waveguide structures, the conversion between the TE and TM modes, the extraction of the TM modes of electromagnetic radiation from the filters 32 and 34 at the waveguide 22, and the coupling of the two modes of electromagnetic radiation between the chambers 36 and 38 of the filters 32 and 34 will now be described.

Each of the waveguide assemblies 28 and 30 has the same form of structure, the respective structures differing only with respect to the dimensions of the components thereof, which dimensions are selected in accordance with the frequency of waves to be coupled between the assemblies 28 and 30 and their respective filters 32 and 34. Accordingly, only the assembly 28 need be described in detail, the description thereof applying equally well to the assembly 30.

The waveguide assembly 28 is constructed in the form of a 3 dB (decibels) coupler 40 formed of two rectangular waveguides 42 and 44 sharing a common sidewall 46, which sidewall has an aperture 48 for coupling electromagnetic energy between the two waveguides 42 and 44. The waveguide assembly 28 has a top wall 50 and a bottom wall 52 which extend across the waveguides 42 and 44 to serve as top and bottom walls of the waveguides 42 and 44. The top wall 50 and the bottom wall 52 are joined by sidewalls 54 and 56 and the common sidewall 46 to form the structure of each of the waveguides 42 and 44. The cross section of each of the waveguides 42 and 44 has an aspect ratio of 2:1 wherein the width of the top wall of each of the waveguides 42, 44 is double the height of the sidewall 46. Also included are well-known tuning structures (not shown) located on the walls about the aperture 48. A front end of the waveguide 42 is extended to form an input port 26. The front end of the waveguide 44 is provided with a dummy load 58.

In order to excite the TM and TE modes in the filter 32, two coupling assemblies 60 and 62 are located in the common bottom wall 52 of the two waveguides 42 and 44, the coupling assembly 60 being positioned within the waveguide 42 and the coupling assembly 62 being positioned within the waveguide 44. Each of the coupling assemblies 60 and 62 is formed of a circular aperture 64 within the bottom wall 52 and a rod 66 of smaller diameter than the diameter of the aperture 64, the rod 66 being oriented perpendicularly to the bottom wall 52. The rods 66 extend from their respective waveguides 42 and 44 through the apertures 64 into the upper resonant chamber 36. Tuning posts 68 and 70 are located in the chamber 36 diametrically opposite the coupling assemblies 62 and 60, respectively, and extend in the chamber 36 from the wall 52.

Each of the coupling assemblies 60 and 62 is in the form of a coax-to-waveguide adapter or probe which may be dimensioned, in accordance with well known adapter and probe technology, to produce the desired coupling of the $TM_{110}$ modes between the waveguides 42 and 44 and the upper chamber 36. The width and height of each of the tuning posts 68 and 70 is adjusted to cancel out any direct coupling of electromagnetic energy between the coupling assemblies 60 and 62.

In accordance with a feature of the invention, the coupler 40 divides the power of an input signal at an input port 26 equally between the waveguides 42 and 44. A characteristic of the coupler 40 is the fact that an electromagnetic wave coupled into the waveguide 44 experiences a phase shift of 90 degrees relative to the phase of the wave in the waveguide 42. As a result, electromagnetic waves coupled by the coupling assemblies 60 and 62 are out of a phase by 90 degrees. The two coupling assemblies 60 and 62 are spaced apart from the common sidewall 46 by approximately one-third of the width of the respective waveguides 42 and 44. The two coupling assemblies 60 and 62 excite the orthogonal $TM_{110}$ modes in the chamber 36.

In accordance with the invention, an upper coupling disc 72 of a metal such as copper is placed at the top of a chamber 36 adjacent the two rods 66, the disc 72 being secured to the underside of the bottom wall 52. The disc 72 interacts with the $TM_{110}$ modes to excite the $TE_{112}$ modes of corresponding polarization. Thereby, both TE and TM modes are present in the chamber 36.

In the construction of the multiplexer 20, the assemblies 28 and 30, the filters 32 and 34, and the waveguide 22 are all constructed of metal, such as copper, as is common practice in the construction of waveguides and similar microwave components.

Similarly, the tuning posts 68 and 70 and the rods 66 are also constructed of a metal such as copper. In order to hold the rods 66 centered within their respective apertures 64, a plug 74 of electrically-insulating dielectric material, which may be a ceramic such as alumina, is disposed within each of the apertures 64. The plugs 74 are transparent to the electromagnetic radiation. The disc 72 may be secured by soldering to the underside of the wall 52.

The two chambers 36 and 38 are separated by a wall 76 which extends diametrically across the cylindrical space of the filter 32 bounded by an outer cylindrical wall 78. The wall 76 is supported by the cylindrical wall 78.

In accordance with a feature of the invention, four coupling assemblies 80, 82, 84, and 86 are disposed in the wall 76 and are positioned uniformly about a center of the wall 76. In the preferred embodiment of the invention, the cylinder formed by the wall 78 is a right circular cylinder, and the coupling assemblies 80, 82, 84, and 86 are positioned with ninety-degree spacing about the center of the wall 76. Each of the coupling assemblies 80–86 comprises a slot 88 having the form of a circular segment, and a rod 90 extending through the slot 88 perpendicularly to the wall 76. Each of the rods 90 is secured to the wall 76 by a bushing 92 of electrically-insulating dielectric material transparent to the electromagnetic radiation. Each of the slots 88 extends approximately 60 degrees in the circumferential direction, the exact amount being determined experimentally. The length and width of each of the slots 88, and the length of the rods 90 is adjusted to provide a desired coefficient of coupling between the corresponding modes in the chambers 36 and 38. The slots 88 are disposed on a common circle having a diameter such that, in the preferred embodiment of the invention, the four rods 90 are in alignment with respective ones of the two rods 66 and the two posts 68 and 70. The slots 88 provide for the coupling of only the $TE_{112}$ modes, and the rods 90 provide for the coupling of only the $TM_{110}$ modes in the chambers 36 and 38. The independence of coupling is determined by the radius of the slots 88 because there is no radial component of current in the wall 76 due to the $TM_{110}$ modes at the locations of the slots 88. No axial current is present in the rods 90 due to the $TE_{112}$ modes.

The waveguide 22 comprises a top wall 94 and a bottom wall 96 which are joined by sidewalls 98 and 100. As viewed in cross-section, the top and bottom walls 94 and 96 constitute broadwalls of the waveguide 22 and the sidewalls 98 and 100 constitute narrow walls of the waveguide 22.

Coupling of electromagnetic energy via the $TM_{110}$ modes between the waveguide 22 and the filters 32 and 34 is accomplished by waveguide assemblies 102 and 104 extending from the sidewall 100. The two assemblies 102 and 104 connect respectively with the filters 32 and 34 for coupling electromagnetic power outputted by the filters 32 and 34 to the waveguide 22. While only two output waveguide assemblies 102 and 104 are shown in the figures, it is to be understood that additional ones of these assemblies are to be provided corresponding to the number of filters and input ports 26 employed in the construction of the multiplexer 20.

The construction of the output waveguide assemblies 102 and 104 follows that of the input waveguide assemblies 28 and 30. Each of the output waveguide assemblies 102 and 104 includes a 3 dB coupler 106 comprising two waveguides 108 and 110 of rectangular cross section, the two waveguides 108 and 110 sharing a common sidewall 112 having an aperture 114 for coupling power between the two waveguides 108 and 110. The top wall 94 and the bottom wall 96 extend over the waveguide assemblies 102 and 104 to form top and bottom walls of the waveguides 108 and 110. Sidewalls 116 and 118 and the common sidewall 112 in each of the assemblies 102 and 104 join the top and bottom walls of the assemblies 102 and 104 to form the waveguides 108 and 110. The dimensions of the aperture 114 and the inclusion of well-known tuning structures (not shown) disposed in the walls about the aperture 114 insure equal power division and a 90 degree phase shift between electromagnetic waves in the two waveguides 108 and 110. Coupling assemblies 120 and 122 are located in the top wall 94 of each of the waveguides 108 and 110 and extend through the top wall 94 for coupling electromagnetic energy between the lower chamber 38 and the waveguide 22. Each of the coupling assemblies 120 and 122 is formed of a section of coaxial transmission line having an inner conductor 124 and an outer conductor 126 which pass through the top wall 94 for coupling energy of the $TM_{110}$ modes between the chamber 38 and the waveguide 22. The outer conductor 126 is formed simply of the walls of an aperture in the top wall 94. Torroidal dielectric plug 128 supports the inner conductor 124 within the outer conductor 128. Tuning posts 130 and 132 extend from the top wall 94 into the chamber 38, access to the tuning posts 130 and 132 for adjustment of their height being had via the waveguides 108 and 110, respectively. The tuning posts 130 and 132 may be formed as screws which may be advanced into the chamber 38 by rotation of the screws, thereby to tune the chamber 38 to the electromagnetic radiation. The posts 130 and 132 are positioned so as to be in alignment with the coupling assemblies 60 and 62 of an input waveguide assembly, and the coupling assemblies 120 and 122 are positioned so as to be in alignment with the tuning posts 68 and 70 of an input waveguide assembly. The multiplexer 20 is operable also upon interchanging the positions of the posts 130 and 132 with the coupling assemblies 120 and 122 because of symmetry in the generation of electromagnetic waves by the coupling assemblies 80–86 in the wall 76.

In the construction of the waveguide assemblies 102 and 104, the common wall 112 extends all the way, except for the aperture 114, from the sidewall 98 of the waveguide 22 to the opposite end of an output waveguide assembly 102, 104. It is also noted that the waveguide assemblies 102, and 104 do not contain a dummy load as do the input waveguide assemblies 28 and 30. The lack of the dummy load and the replacement thereof with a reflection end wall allows power propagating along the waveguide 22 to pass through the aperture 114 of a coupler 106 and to continue propagating along the waveguide 22 without attenuation to the output port 24.

A feature of the invention, as has been noted hereinabove, is the fact that individual ones of the filters 32 and 34 in cooperation with their respective coupling assemblies 120 and 122 provide for substantially no interaction with electromagnetic signals propagating along the waveguide 22 in frequency bands different from the passbands of the respective filters 32 and 34. Only in the case of an electromagnetic wave having the frequency to which a filter is tuned, does a filter, such as the filter 32, interact with the electromagnetic wave so as to provide for a path of propagation between the waveguide 22 and an input port 26.

Figure 4:
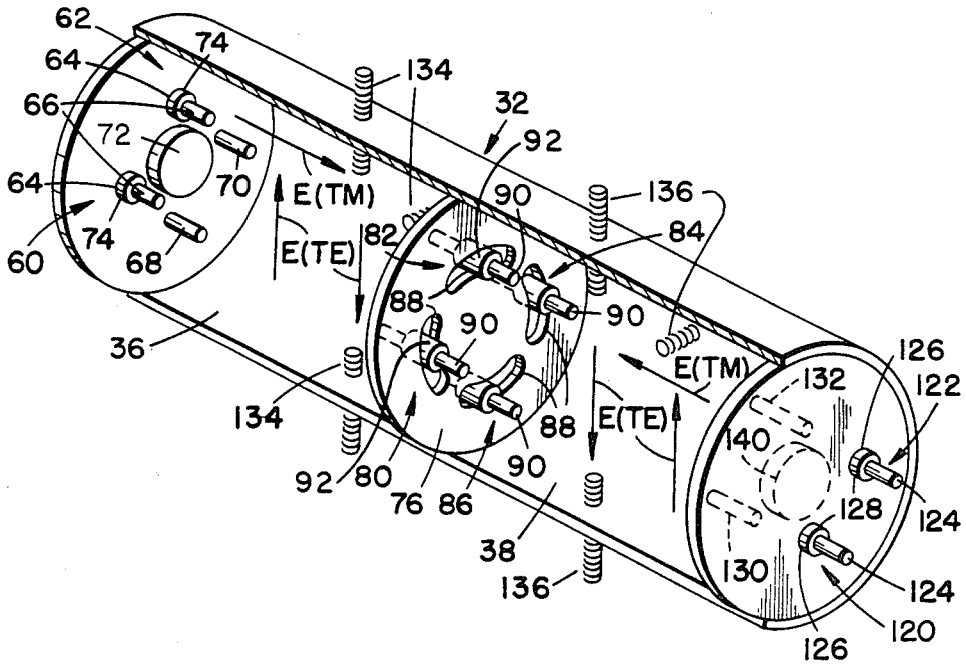
FIG. 4 is an isometric view, shown diagrammatically, of a filter of FIG. 3.

To facilitate the tuning of the filters 32 and 34, the upper chamber 36 is provided with four tuning screws 134 (three of which are shown in FIG. 4) and the lower chamber 38 is provided with four tuning screws 136 (three of which are shown in FIG. 4). The tuning screws 134 and 136 are disposed in the cylindrical wall 78, and are directed inwardly along a diameter of the cylindrical wall 78. The four tuning screws 134 are positioned uniformly, 90 degrees apart, about a longitudinal cylindrical axis of the chamber 36 and, similarly, the four tuning screws 136 are positioned uniformly about a longitudinal cylindrical axis of the chamber 38. Each of the chambers 36 and 38 has an axial length of one guide wavelength of the $TE_{112}$ mode along the central cylindrical axis. The four tuning screws 134 are positioned approximately one-quarter of the guide wavelength in the $TE_{112}$ mode from the wall 76, and the four tuning screws 136 are positioned approximately one-quarter of the guide wavelength in the $TE_{112}$ mode from the opposite side of the wall 76. Corresponding ones of the tuning screws 134 and 136 are disposed in common vertical planes containing the cylindrical axis. The tuning screws 134 and 136 are operative for tuning resonant frequencies of the $TE_{112}$ waves. A turning of a screw 134, 136, adjusts the amount of penetration of the screw into the respective chambers 36 and 38 for tuning the TE mode of propagation within these chambers. It may also be desirable to provide tuning for the $TM_{110}$ mode by use of insulated electrically-conductive pins (not shown) positioned inside each of the chambers 36 and 38 and oriented parallel to the cylindrical axis in each of the chambers 36 and 38. Signals inputted at the ports 26 and coupled via the filters 32 and 34 to the waveguide 22 are excited to propagate essentially in one direction, toward the output port 24, in the waveguide 22 due to the action of each output coupler 106 in summing together the waves in the waveguides 108 and 110 to form a resultant wave propagating toward the output port 24. A load 138 (FIG. 1) dissipates electromagnetic power flowing in a direction opposite the output port 24, thereby to prevent reflections of the signals from the back end of the waveguide 22. Electric field vectors for the $TE_{112}$ and the $TM_{110}$ modes are also shown in FIG. 4, the electric field vectors being identified by E(TE) and E(TM), respectively for the TE and TM modes.

The bottom of the chamber 38 and the top of the chamber 36 have the same configuration of microwave components to enable the conversion of a part of the electromagnetic energy between the TM and the TE modes, and the coupling of electromagnetic energy into and out of the filters 32 and 34 by the $TM_{110}$ modes of electromagnetic waves. The disc 140 is placed at the bottom of the chamber 38 and secured to the top wall 94, the disc 140 having the same configuration as the disc 72 located at the top of the upper chamber 36. Both the discs 72 and 140 are centered on the cylindrical axis of the filter 32 and are centered between their respective coupling assemblies and tuning posts. Thus, the two coupling assemblies 60 and 62 and the two tuning posts 68 and 70 are positioned about the disc 72 at equal radial distances from the center of the disc 72. Similarly, the two coupling assemblies 120 and 122 and the two posts 130 and 132 are positioned at equal radial distances from the center of the disc 140.

In operation, the foregoing construction of the multiplexer 20 with the two filters 32 and 34 may be regarded as a filter with characteristics which are particularly suited for a contiguous channel microwave multiplexer. Each of the filters 32 and 34 comprises a linear set of cylindrical cavities (chambers 36 and 38) proportioned to support four modes of electromagnetic waves in each cavity, the cavities being resonated at the channel frequency. The modes include vertically polarized $TM_{110}$ and $TE_{112}$ which are coupled to each other, and the corresponding horizontally polarized TM and TE modes. The vertical and the horizontal polarization provide equal and independent paths through the filter (filters 32 and 34) capable of propagating a circularly polarized signal. Coupling between adjacent chambers 36 and 38 for $TE_{112}$ type modes and for $TM_{110}$ type modes serve as a bridge circuit for generating transmission nulls. The foregoing coupling assemblies and the coupling disc 72 and 140 introduce the characteristics of a complementary type directional bandpass filter appropriate for a contiguous channel multiplexer.

The above-described microwave construction of the multiplexer 20 provides the characteristics of a filter having two transmission poles per cavity for two polarizations, this being double the number of transmission poles obtainable heretofore. As a result, the filters 32 and 34 can be constructed with a reduced number of chambers, only the two chambers 36 and 38 being employed in the preferred embodiment, it being understood that additional chambers could be employed in other embodiments of the invention for further control of the bandpass characteristic in each of the filters. The transmission nulls can be adjusted by the bridge coupling at the coupling assemblies 80–86 in the wall 76 so as to provide for steeper skirts in the transmission characteristics portrayed in FIG. 5. The foregoing configuration provides an improved type of complementary-filter contiguous-channel multiplexer.

The reduction in size and weight is desirable for use in satellites having phased array antennas so as to obtain a more nearly optimum antenna and feed system. Details in the construction of filters and coupling devices is disclosed in the textbook "MICROWAVE IMPEDANCE MATCHING NETWORKS" by G. Mattaei, L. Young, and E. M. F. Jones, and also in the textbook "FIELDS AND WAVES IN MODERN RADIO" by S. Ramo and J. R. Whinnery. By way of example of the improvement offered by the invention, a filter disclosed in chapter 14 of Mattei et al has two polarizations with one transmission hole and no transmission nulls per cavity. The additional modes, poles, and nulls provided by the structure of the invention allows the attainment of a more useful bandpass characteristic with reduced weight and bulk of microwave components.

With respect to the operation of the multiplexer 20, in the upper chamber 36, the coupling assembly 60 and 62 in cooperation with the disc 72 and the tuning posts 68 and 70 introduce two independent $TM_{110}$ modes which provide circularly polarized waves in the chamber 36. Equal reflection in the coaxial structures of the coupling assemblies 60 and 62 return power to the dummy load 58. The radii which locate the coupling assemblies 60 and 62 and the tuning posts 68 and 70 about the disc 72 are oriented 90 degrees apart from each other. The radial distance of each slot 88 is slightly less than half the radius of the chamber 36, namely, 0.480 times the chamber radius. At these points, the z component of the electric field is at a maximum and the circumferential component of the magnetic field is zero. The pair of posts 68 and 70, by virtue of their positions diametrically opposite the rods 66, balance out a direct coupling of electromagnetic energy between the coupling assemblies 60 and 62. Similar comments apply to the coupling assemblies 120 and 122 at the bottom of the lower chamber 38.

The discs 72 and 140 are relatively thin as compared to a guide wavelength, the thicknesses of the discs being less than approximately one-tenth of the guide wavelength. If desired, the disc can be replaced by a thin ring (not shown) along the outer periphery of the end wall of a chamber. Couplings of electromagnetic power are of opposite sense for the disc and the ring because the radial current in the end wall reverses at the foregoing value of radius (for location of the tuning posts 68 and 70) from the center for the $TM_{110}$ mode, while there is no radial current reversal for the $TE_{112}$ mode. In the event that convex or concave end walls were used in place of the disc or ring, the convex and concave walls would produce $TM_{110}$ to $TE_{112}$ couplings of opposite polarity, and resemble in a crude way the foregoing disc and ring.

The slots 88 permit the coupling of $TE_{112}$ modes from one chamber 36 to the other chamber 38 without a coupling of $TM_{110}$ modes. The rods 90 passing through the slots 88 provide for the coupling of $TM_{110}$ modes between the chambers 36 and 38, such coupling of the $TM_{110}$ mode being obtained independently of the coupling of $TE_{112}$ modes. Probe coupling, by the rods 90, is the independent of the hole coupling, by the slots 88, in that the hole coupling applies only to TE modes while the probe coupling applies only to TM modes. The combination structure of the slots 88 and their rods 90 permit independent adjustment of the coupling coefficients of the TE and the TM modes.

Reduction of the various coupling coefficient results in a narrowed bandpass characteristic and, in addition, the time of propagation of a signal through the filter 32, 34 is increased. An enlargement of the coupling coefficient has the reverse effect. The foregoing structure is most versatile by allowing for independent control of the coupling or both TE and TM waves, both of which waves serve to carry the signal power. The result is a closer spacing of the contiguous signal spectra to allow for more signals in a given multiplexer bandwidth, while reducing the weight and bulk of the multiplexer.

It is to be understood that the above described embodiment of the invention is illustrative only, and that modifications thereof may occur to those skilled in the art. Accordingly, this invention is not to be regarded as limited to the embodiment disclosed herein, but is to be limited only as defined by the appended claims.

What is claimed is:

1. A multiplexer for electromagnetic signals occupying separate regions of the electromagnetic spectrum said multiplexer comprising:

a plurality of input signal channels and a common output signal channel each of said input channels comprising:

a plurality of cavities connected in series, said cavities being tuned to the spectral region of one of said signals;

an input coupler connected to a first cavity of said series for exciting four modes of electromagnetic wave progagation in said first cavity including a pair of orthogonally polarized transverse-magnetic (TM) modes in phase quadrature and a pair of orthogonally polarized transverse-electric (TE) modes in phase quadrature;

an output coupler connected between a last cavity of said series and said output channel; and an intercavity coupler connected between each pair of successive cavities of said series, each of said couplers inlcuding means for interacting with respective ones of said cavities for launching and receiving electromagnetic waves propagating in dual modes of propagation including both transverse-electric and transverse-magnetic modes, said dual modes of propagation providing greater attenuation of signal components lying outside the passband of a signal channel to permit a closer spacing of the spectral portions of said signals.

2. A multiplexer according to claim 1 wherein said input coupler and said output coupler in one of said input channels each comprise:

a full-power port, a first half-power port, and a second half-power port; and means for transferring equal amounts of power between said full-power port and each of said half-power ports, said transferring means interjecting a 90 degree phase shift between signals of said first half-power port and said second half-power port, said half-power ports of said input coupler extending into said first cavity, said half-power ports of said output coupler extending into said last cavity, each of said half-power ports providing one mode of propagation; and wherein said first and said last cavities each comprise converting means being a part, respectively, of said input coupler and said output coupler, said converting means being coupled to said half-power ports of the respective couplers for converting a portion of electromagnetic power to another mode of propagation, one of said modes being transverse-magnetic, and another of said modes being transverse-electric.

3. A multiplexer according to claim 2 wherein said intercavity coupler comprises transverse-electric coupling means and transverse-magnetic coupling means, each being individually adjustable for selection of a coefficient of coupling of electromagnetic energy.

4. A multiplexer according to claim 3 wherein each of said half-power ports comprises a probe extending into a cavity for coupling a transverse-magnetic mode of propagation.

5. A multiplexer according to claim 4 wherein the converting means in each said first cavity and said last cavity is a disc positioned adjacent said probes of said half-power ports for producing a conversion between transverse-electric and transverse-magnetic modes of propagation.

6. A multiplexer according to claim 5 wherein said transverse-electric coupling means of said intercavity coupler comprises a set of circular-segment slots.

7. A multiplexer according to claim 6 wherein said transverse-magnetic coupling means of said intercavity coupler comprises a set of probes extending through said common wall between contiguous cavities.

8. A multiplexer according to claim 7 wherein, in said transverse-magnetic coupling means of said intercavity coupler, said probes are located within respective ones of said circular-segment slots and insulated from said common wall, said slots being positioned in said common wall at locations of minimal radial current induced by electromagnetic fields in said cavities.

9. A multiplexer according to claim 8 wherein each of said circular-segment slots have the same radius.

10. A multiplexer according to claim 3 wherein said transverse-electric coupling means of said intercavity coupler comprises a set of circular-segment slots.

11. A multiplexer according to claim 10 wherein said transverse-magnetic coupling means of said intercavity coupler comprises a set of probes extending through said common wall between contiguous cavities.

12. A multiplexer according to claim 11 wherein, in said transverse-magnetic coupling means of said intercavity coupler, said probes are located within respective ones of said circular-segment slots and insulated from said common wall, said slots being positioned in said common wall at locations of minimal radial current induced by electromagnetic fields in said cavities; and wherein each of said circular-segment slots have the same radius, the lengths of said circular-segment slots and of said probes of said intercavity coupler being selected to provide a desired coefficient of coupling of electromagnetic energy between contiguous cavities, thereby to form a desired bandpass characteristic to a channel of said multiplexer.

13. A multiplexer according to claim 12 wherein each of said cavities has the shape of a right circular cylinder, said common output channel being structured as a waveguide having rectangular cross-section and wherein said transverse electric mode is a $TE_{112}$ mode as measured in cylindrical coordinates, and said transverse-magnetic mode is a $TM_{110}$ mode as measured in cylindrical coordinates, each of said input and said output couplers being structured as two rectangular waveguides sharing a common sidewall having a coupling aperture therein, said coupling aperture serving as said means for transferring power, terminals of said rectangular waveguides of said input and said output couplers serving as said half-power ports.

14. A multiplexer for electromagnetic signals comprising:

a plurality of input channels tuned to a plurality of signal frequencies;

a common output channel coupled to each of said input channels;

means in each of said input channels for dividing input signal power substantially equally into two linearly polarized transverse-magnetic (TM) waves modes in phase quadrature;

each of said input channels including at least two cavities resonant at one of said signal frequencies, there being means in each of said cavities for converting approximately half the energy of a TM wave to a TE wave, there being an intercavity coupler coupling a first and a second of said cavities, said intercavity coupling comprising a TE coupling structure and a TM coupling structure which are independently configured to establish coefficients of coupling of TE and TM waves between said first and said second cavities; and means in each of said channels for combining TE and TM waves to regenerate a signal inputted to respective ones of said input channels, said combining means connecting with said output channel for summing the resepctive signals in a said output channel.

15. A multiplexer according to claim 14, wherein, in each of said input channels, said power dividing means comprises two contiguous waveguides sharing a common sidewall having an aperture therein for coupling electromagnetic power between the two waveguides, one of said waveguides being open for receiving an input signal, said first cavity being a right circular cylinder having an end wall perpendicular to said common wall, there being a disc located on said end wall and centered on a plane of said common wall, a second end of said first waveguide and a corresponding end of said second waveguide being provided with probes having the shape of rods and extending from each of said waveguides into said first cylinder outside and adjacent to said disc, there being a pair of posts extending on an opposite side of said disc in parallel relation to said two probes and electrically connected to said end wall, there being a terminating load in a first end of said second waveguide, the configuration of said two waveguides and said aperture introducing a 90 degree phase shift between electromagnetic energy coupled between a probe of said first waveguide and a probe of said second waveguide, said two probes launching a TM wave into said first cavity in a $TM_{110}$ mode in cylindrical coordinates, said disc interacting with said TM modes to convert electromagnetic energy carried by said probes in a TE wave having a $TE_{112}$ mode in cylindrical coordinates, and wherein each of said probes is insulated from its respective waveguide and from the end wall of said first cavity by cylindrical dielectric elements.

16. A multiplexer according to claim 14 wherein, in each of said input channels, said second cavity is a right circular cylinder sharing a common end wall with said first cavity, and wherein said intercavity coupling comprises a set of four circular-segment slots disposed at equal radii in said common end wall about a common cylindrical axis of said first and said second cavities, said intercavity coupling further comprising a set of four probes formed as rods extending perpendicular to said common end wall of said first and said second cavities, said probes of said intercavity coupling being located at the centers of respective ones of said slots and insulated from said common end wall; and wherein the lengths of said probes and the lengths of said slots of said intercavity coupling are independently selectable to provide for coefficients of coupling of TM and TE waves, respectively, between said first cavity and said second cavity for shaping a bandpass characteristic of said channel.

17. A multiplexer according to claim 14 wherein, in each of said input channels, said power dividing means connects with said first of said cavities and said power combining means connects with a last one of said cavities;

said power dividing means and said power combining means each comprises two contiguous waveguides sharing a common sidewall having an aperture therein for coupling electromagnetic power between the two waveguides one of said waveguides being open for receiving an input signal, each of said cavities being a right circular cylinder having an end wall perpendicular to said common wall, there being a disc located on said end wall and centered on a plane of said common wall, a second end of said first waveguide and a corresponding end of said second waveguide being provided with probes having the shape of rods and extending from each of said waveguides into said first cylinder outside and adjacent to said disc, there being a pair of posts extending on an opposite side of said disc in parallel relation to said two probes, there being a terminating load in a first end of said second waveguide, the configuration of said two waveguides and said aperture introducing a 90 degree phase shift between electromagnetic energy coupled between a probe of said first waveguide and a probe of said second waveguide, said two probes launching TM waves into said first cavity in a $TM_{110}$ mode in cylindrical coordinates, said disc interacting with said TM waves to convert a portion of electromagnetic energy carried by said TM waves to TE waves having a $TE_{112}$ mode in cylindrical coordinates, and wherein each of said probes is insulated from its respective waveguide and from the end wall of said first cavity by cylindrical dielectric elements; and wherein there is a terminating load in a first end of said second waveguide in said power dividing means, and a reflecting wall in a first end of said second waveguide in said power combining means;

said common output channel is a waveguide having a sidewall, said second ends of said first and said second waveguides of said power combining means in each of said input channels opening into said sidewall of said output channel for summing together signals of respective ones of said input channels.

18. A filter for electromagnetic signals comprising means for dividing input signal power into two circularly polarized waves, one of which is a transverse-magnetic (TM) wave and one of which is a transverse-electric (TE) wave;

each of said input channels including at least two cavities resonant at one of said signal frequencies, there being an intercavity coupler coupling a first and a second of said cavities, said intercavity coupling comprising a TE coupling structure and a TM coupling structure which are independently configured to establish coefficients of coupling of TE and TM waves between said first and said second cavities; and means for combining TE and TM waves to regenerate a signal inputted to respective ones of said input channels.

19. A filter according to claim 18 wherein said power dividing means comprises two contiguous waveguides sharing a common sidewall having an aperture therein for coupling electromagnetic power between the two waveguides, one of said waveguides being open for receiving an input signal, said first cavity being a right circular cylinder having an end wall perpendicular to said common wall, there being a disc located on said end wall and centered on a plane of said common wall, a second end of said first waveguide and a corresponding end of said second waveguide being provided with probes having the shape of rods and extending from each of said waveguides into said first cylinder outside and adjacent to said disc, there being a pair of posts extending on an opposite side of said disc in parallel relation to said two probes, there being a terminating load in a first end of said second waveguide, the configuration of said two waveguides and said aperture introducing a 90 degree phase shift between electromagnetic energy coupled between a probe of said first waveguide and a probe of said second waveguide, said two probes launching TM waves into said first cavity in a $TM_{110}$ mode in cylindrical coordinates, said disc interacting with said TM waves to convert a portion of electromagnetic energy carried by said probes to TE waves having a $TE_{112}$ mode in cylindrical coordinates, and wherein each of said probes is insulated from its respective waveguide and from the end wall of said first cavity by cylindrical dielectric elements.

20. A filter according to claim 19 wherein said power dividing means connects with said first of said cavities and said power combining means connects with a last one of said cavities;

said power dividing means and said power combining means each comprises two contiguous waveguides sharing a common sidewall having an aperture therein for coupling electromagnetic power between the two waveguides one of said waveguides being open for receiving an input signal, each of said cavities being a right circular cylinder having an end wall perpendicular to said common wall, there being a disc located on said end wall and centered on a plane of said common wall, a second end of said first waveguide and a corresponding end of said second waveguide being provided with probes having the shape of rods and extending from each of said waveguides into said first cylinder outside and adjacent to said disc, there being a pair of posts extending on an opposite side of said disc in parallel relation to said two probes, there being a terminating load in a first end of said second waveguide, the configuration of said two waveguides and said aperture introducing a 90 degree phase shift between electromagnetic energy coupled between a probe of said first waveguide and a probe of said second waveguide, said two probes launching TM waves into said first cavity in a $TM_{110}$ mode in cylindrical coordinates, said disc interacting with said TM waves to convert a portion of electromagnetic energy carried by said probes to TE waves having a $TE_{112}$ mode in cylindrical coordinates, and wherein each of said probes is insulated from its respective waveguide and from the end wall of said first cavity by cylindrical dielectric elements; and wherein there is a terminating load in a first end of said second waveguide in said power dividing means, and a reflecting wall in a first end of said second waveguide in said power combining means.

* * * * *